US010470969B2

(12) United States Patent
Johnston

(10) Patent No.: US 10,470,969 B2
(45) **Date of Patent: *Nov. 12, 2019**

(54) BODY ROLLER APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 794 days.

This patent is subject to a terminal disclaimer.

(21) Appl. No.: 14/981,979

(22) Filed: Dec. 29, 2015

(65) Prior Publication Data

US 2016/0235620 A1 Aug. 18, 2016

Related U.S. Application Data

(63) Continuation of application No. 13/573,178, filed on Aug. 28, 2012, now Pat. No. 9,241,865, which is a continuation-in-part of application No. 12/284,376, filed on Sep. 22, 2008, now abandoned.

(51) Int. Cl.
*A61H 15/00* (2006.01)

(52) U.S. Cl.
CPC ..... *A61H 15/00* (2013.01); *A61H 2015/0042* (2013.01); *A61H 2015/0064* (2013.01); *A61H 2201/0138* (2013.01); *A61H 2201/0161* (2013.01); *A61H 2201/0192* (2013.01); *A61H 2203/0425* (2013.01); *A61H 2203/0443* (2013.01); *A61H 2207/00* (2013.01)

(58) Field of Classification Search
CPC ..... A61H 15/00; A61H 2015/0042; A61H 2207/00; A61H 2203/0443; A61H 2203/0425; A61H 2201/0192; A61H 2201/0138; A61H 2201/0161; A61H 2015/0064
See application file for complete search history.

(56) References Cited

U.S. PATENT DOCUMENTS

| | | | | |
|---|---|---|---|---|
| 4,190,043 | A * | 2/1980 | Thompson | A61H 1/00 601/115 |
| 5,501,658 | A * | 3/1996 | Frye | A61H 15/0078 601/84 |
| 6,190,338 | B1 * | 2/2001 | Arndt | A61H 1/00 601/102 |
| 6,309,331 | B1 * | 10/2001 | Raymond | A61H 15/00 482/132 |
| 6,387,063 | B1 * | 5/2002 | Elnar | A61H 15/00 601/112 |
| 9,241,865 | B2 * | 1/2016 | Johnston | A61H 15/00 |
| 2003/0181836 | A1 * | 9/2003 | Cameron | A61H 15/00 601/115 |

* cited by examiner

*Primary Examiner* — Quang D Thanh

(57) ABSTRACT

A body roller apparatus is provided which enables therapy routines to be performed on various body muscle groups. A frame structure is part of the apparatus and includes a base frame with a generally horizontal user support member having an opening being mounted thereon. The upper end of a roller structure rotatably supports a spherical roller, while its lower end mounts to the base frame so that at least a portion of the spherical roller extends through the opening of the user support member. The user operates the apparatus by positioning themselves upon the user support member and engaging with their body the portion of the spherical roller which extends through the opening. The vertical position of the spherical roller may be adjusted, and the frame structure itself may be collapsible for storage.

16 Claims, 15 Drawing Sheets

BODY ROLLER APPARATUS

BACKGROUND OF THE INVENTION

This invention relates to a body roller apparatus which has a generally horizontal user support structure with a roller element supported by the structure that allows the user to perform therapy routines on upper and lower body muscle areas. These routines are performed while in a relatively relaxed position. The ability to engage the muscles of the user with a roller element which rolls against the muscles allows for an easy and comfortable massage type therapy for muscle groups which are sore or have been traumatized due to an accident or illness.

SUMMARY AND OBJECTS OF THE INVENTION

It is the object of this invention to provide a therapeutic apparatus which may provide the user an efficient and inexpensive means for messaging upper and lower body muscle groups. The main purpose of this application is to demonstrate an apparatus which performs the stated function, and to demonstrate the many options and configurations this apparatus may take on.

Briefly stated, the apparatus that forms the basis of the present invention comprises a frame structure means, a roller structure means, and a roller engagement means. The roller structure means is mounted upon the frame structure means, while the roller engagement means is supported by the roller structure means. The user will place themselves upon the frame structure means and engage the roller engagement means with a muscle group. Also, optional features of the apparatus which make the apparatus more flexible are an adjustable roller structure means and a collapsible frame structure means.

The design of the apparatus is such that the roller engagement means is rotatably support by the roller structure means so that the roller engagement means may rotate in any direction. Also, the frame structure means has a relatively horizontal, table-top like user support member, preferably padded, for supporting the user. The user support member has an opening through which the roller engagement means extends to a level which is above the top surface of the user support means. Thus the user is able to engage the roller engagement means with various muscles of the body while being supported by the user support means. The roller engagement means will produce force or pressure against those muscles groups which are engaging the roller engagement means.

This force or pressure should provide relief from soreness, aches, and pains which are located in the engaged muscle group. In addition to providing a type of therapeutic exercise, the apparatus will assist with the removal of fat tissues and cellulite from affected body areas.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
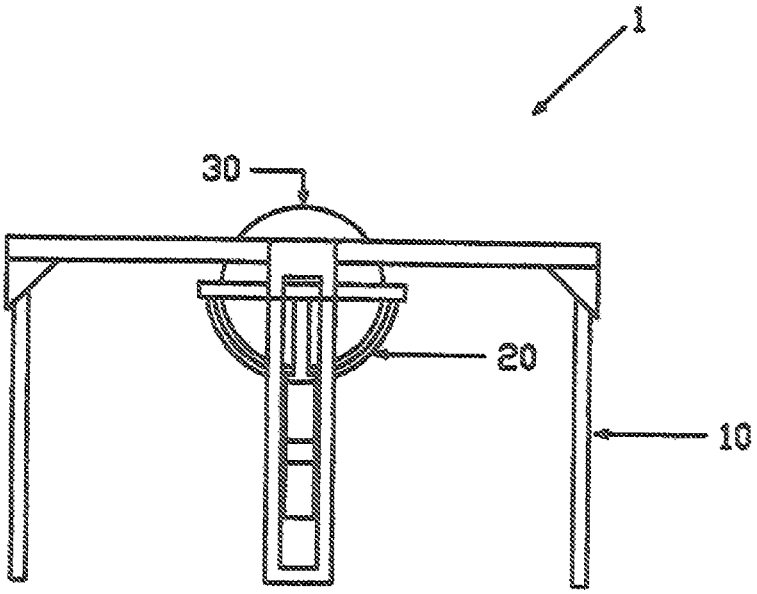
FIG. 1A is a from view of the body roller apparatus.
Figure 1B:
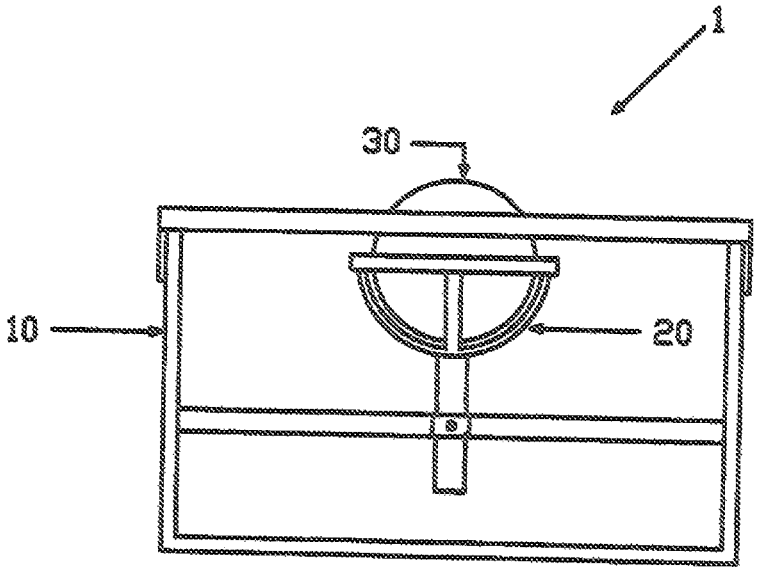
FIG. 1B is a side view of the body roller apparatus.
Figure 1C:
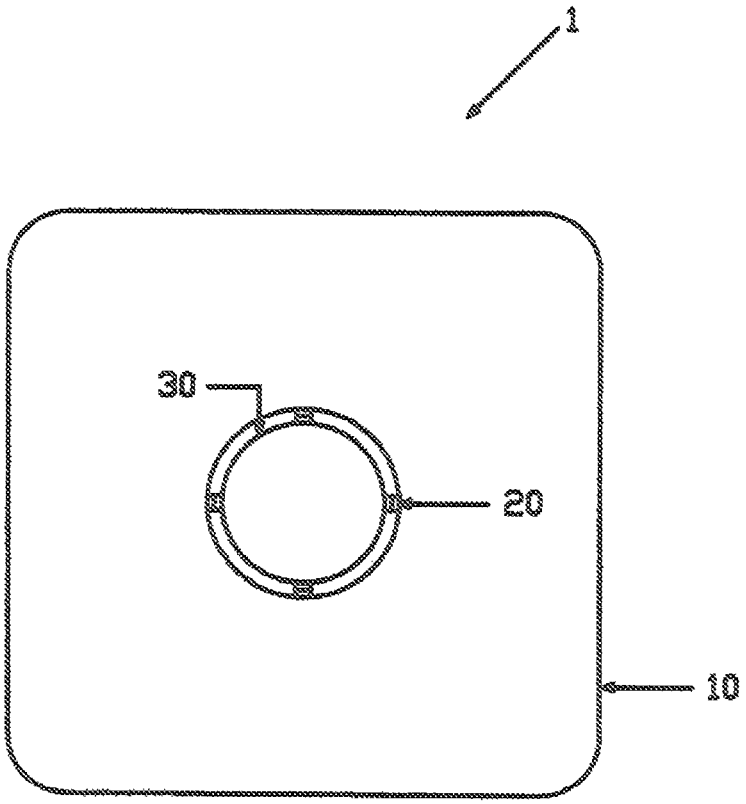
FIG. 1C is a top view of the body roller apparatus.

As best can be seen by references to the drawings, and in particular to FIGS. 1A-1C, the body roller apparatus that forms the basis of the present invention is designated generally by the reference numeral 1, and includes a frame structure means 10, a roller structure means 20, and a roller engagement means 30. The roller structure means 20 is mounted on the frame structure means 10, while the roller engagement means 30 is rotatably supported by the roller structure means 20. A lever adjusting means 40 may also be part of the apparatus which may be used to position the roller structure means at various elevations.

Figure 2A:
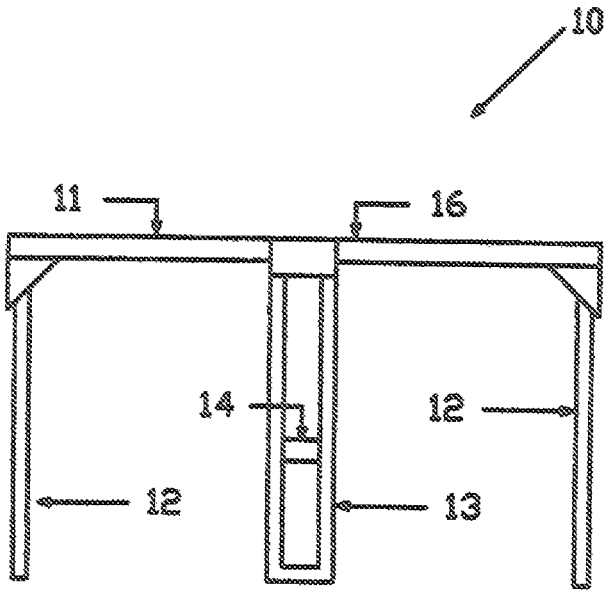
FIG. 2A is a front view of the frame structure means of the body roller apparatus.
Figure 2B:
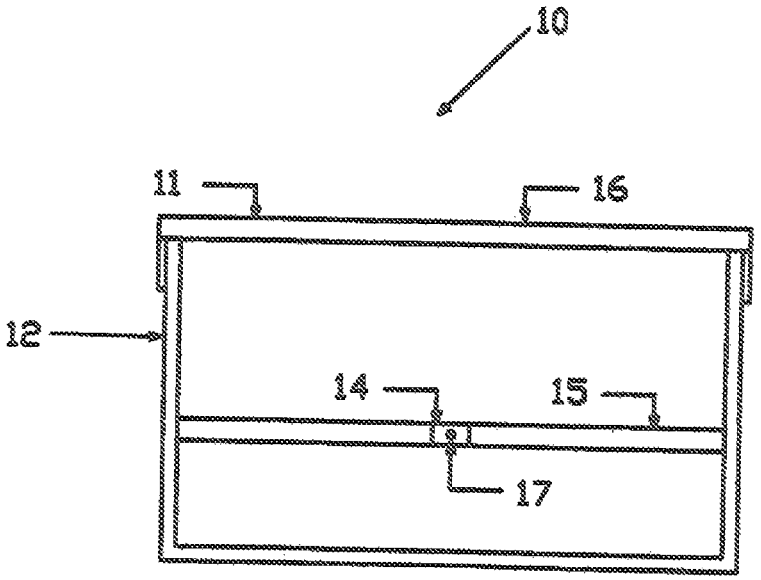
FIG. 2B is a side view of the frame structure means of the body roller apparatus.
Figure 2C:
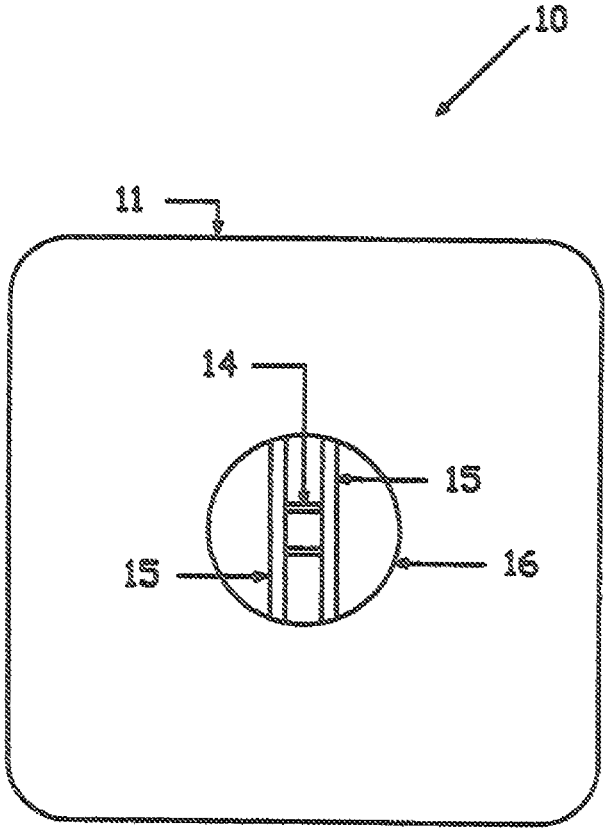
FIG. 2C is a top view of the frame structure means of the body roller apparatus.
Figure 3A:
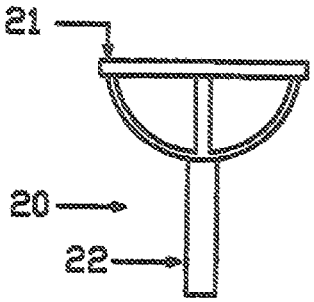
FIG. 3A is a front view of the roller structure means of the body roller apparatus.
Figure 3B:
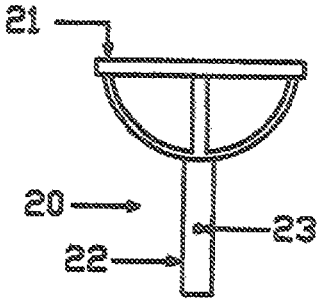
FIG. 3B is a side view of the roller structure means of the body roller apparatus.
Figure 3C:
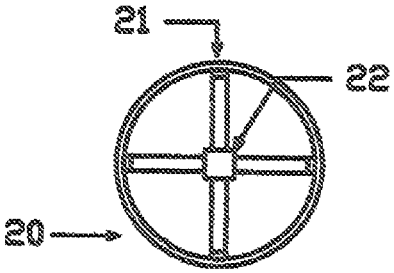
FIG. 3C is a top view of the roller structure means of the body roller apparatus.
Figure 4A:
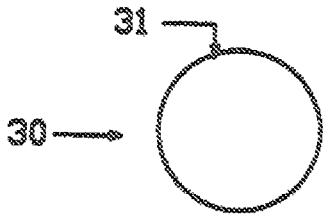
FIG. 4A is a front view of the roller engagement means of the body roller apparatus.
Figure 4B:
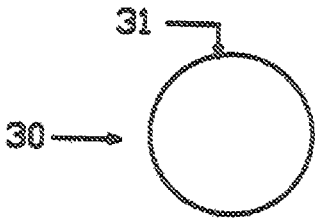
FIG. 4B is a side view of the roller engagement means of the body roller apparatus.
Figure 4C:
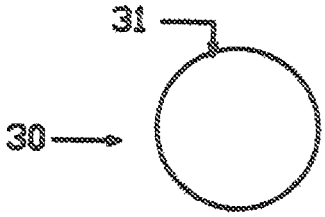
FIG. 4C is a top view of the roller engagement means of the body roller apparatus.

As may be seen in FIGS. 2A-2C, the frame structure means 10 comprises a user support member 11, side support members 12, main support members 13, roller structure support member 14, cross support members 15, roller opening 16, and frame attachment opening 17. The user support member 11 is a relatively horizontal surface, preferably padded, supported along its sides by side support members 12, and along its front and rear by main support members 13. Cross support members 15 connect the front and rear main support members 13, and also supports roller structure support member 14. Roller structure support member 14 is mounted to cross support members 15 directly below roller opening 16, and has a frame attachment opening 17. Roller opening 16 is a generally round opening in the general center of user support member 11.

As may be seen in FIGS. 3A-4C, roller structure means 20 comprises a generally upright main roller structure member 22 with roller support member 21 rigidly mounted thereon. Roller engagement means 30 is comprised of a spherical roller element 31 which is a spherical shaped object having a smooth surface. Roller support member 21 is sized to rotatably receive spherical roller element 31. Roller structure member 22 has a main roller structure opening 23 which is used for mounting the member to frame attachment opening 17 of frame structure means 10.

Figure 5A:
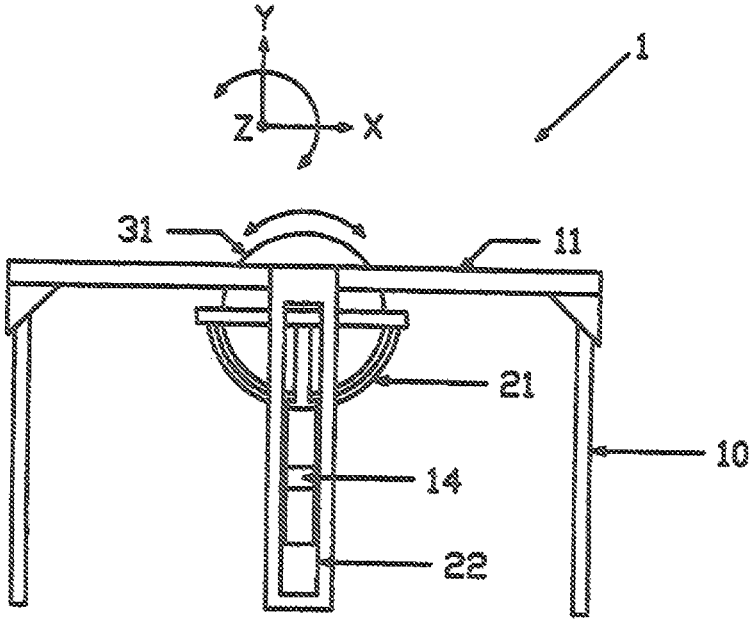
FIG. 5A is a front view of the body roller apparatus showing how the roller engagement means may rotate about a first axis of rotation.
Figure 5B:
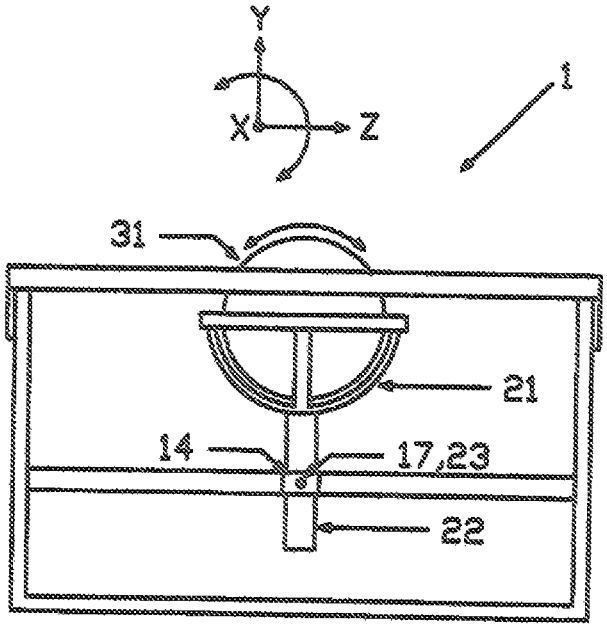
FIG. 5B is a side view of the body roller apparatus showing how the roller engagement means may rotate about a second axis of rotation.
Figure 5C:
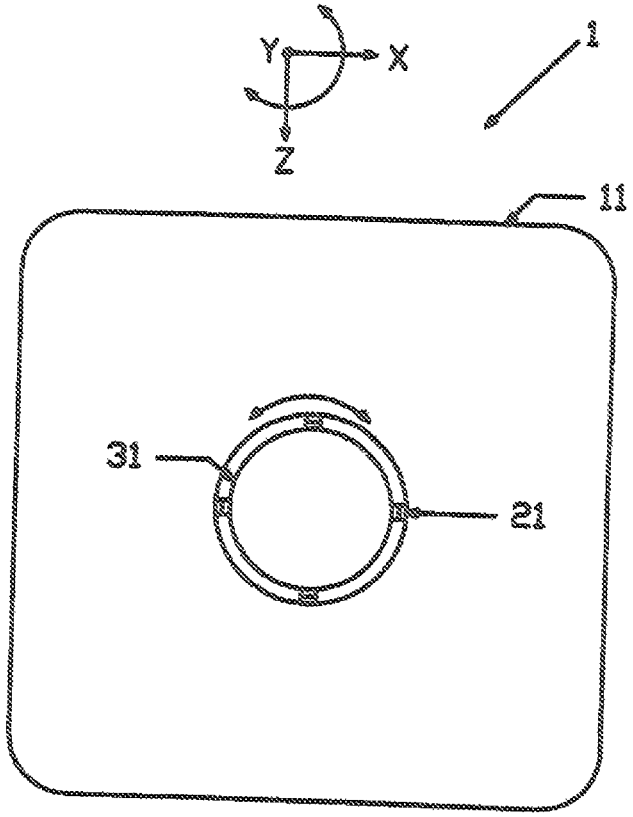
FIG. 5C is a top view of the body roller apparatus showing how the roller engagement means may rotate about a third axis of rotation.

The basic operation of body roller apparatus 1 may be seen in FIGS. 5A-5C. As shown, the main roller structure member 22 of roller structure means 20 fits within roller structure support member 14 of frame structure means 10. Frame attachment opening 17 and main roller structure opening 23 are aligned so that a bolt or pin may be used to secure the two together. As may also be seen, spherical roller element 31 is rotatably supported by roller support member 21, such that spherical roller element 31 may rotate about the X, Y, and Z axes, either one at a time or simultaneous. As may also be seen, a portion of spherical roller element 31 extends above the top surface of the user support member 11 of frame structure means 10. The portion of spherical roller element 31 which extends above user support member 11 is the part which is engaged by spherical roller element 31 with any desired muscle group. Since the roller engagement means 31 is free to rotate in any direction, the user may engage it from any direction, and thus apply a force or pressure to the desired muscle groups from any direction. This ability makes the apparatus extremely flexible and thus very useful.

Figure 6A:
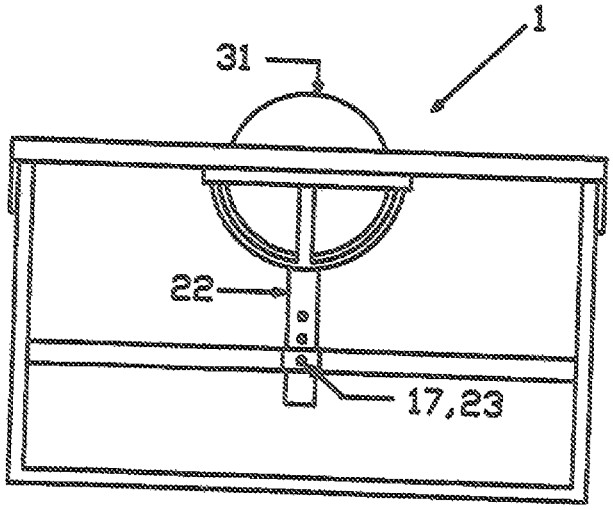
FIGS. 6A, 6B, and 6C are side views of the body roller apparatus, demonstrating an adjustable roller structure means which allows the roller engagement means to be positioned at various elevations.
Figure 6B:
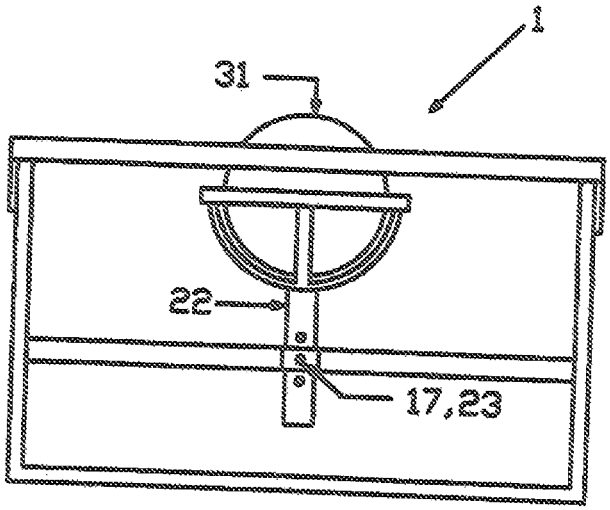
Figure 6C:
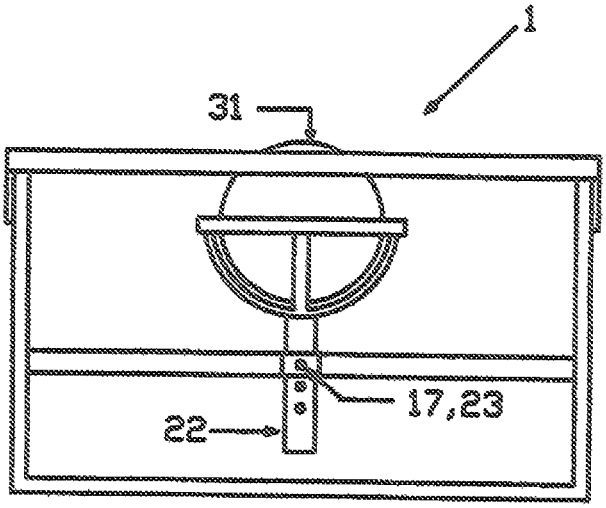

FIGS. 6A-6C demonstrates body roller apparatus 1 having an adjustment feature. The main roller structure member 22 may have several main roller structure openings 23, any of which may be aligned with frame attachment opening 17 and secured via a bolt or pin. Since the main roller structure openings 23 are at different elevations, a portion of spherical roller element 31 may thus be secured at levels above the top surface of user support member 11. This feature allows the user to vary the direction and the amount of the force or pressure exerted by spherical roller element 31 on the desired muscle group. As example, with spherical roller element 31 is in the position shown in FIG. 6A, the user may sit on the user support member 11, and engage spherical roller element 31 with thigh and calf muscle groups. When the spherical roller element 31 is in the position shown in FIG. 6B, the user may lay upon the user support member 11 either face down or on their side, and engage spherical roller element 31 with abdominal muscle groups. When the spherical roller element 31 is in the position shown in FIG. 6C, the user may lay upon the user support member 11 either face up or on their side, and engage spherical roller element 31 with back and neck muscle groups.

The force or pressure exerted by spherical roller element 31 on the respective muscle group will create a therapeutic form of exercise, similar to a message, providing relief from soreness, aches, and pains. These are only examples, and any muscle group may engage the spherical roller element 31 while it is in any position. Also, engaging spherical roller element 31 with the abdominal and thigh muscle groups should assist with the breakdown and removal of fat tissue and cellulite.

Figure 7A:
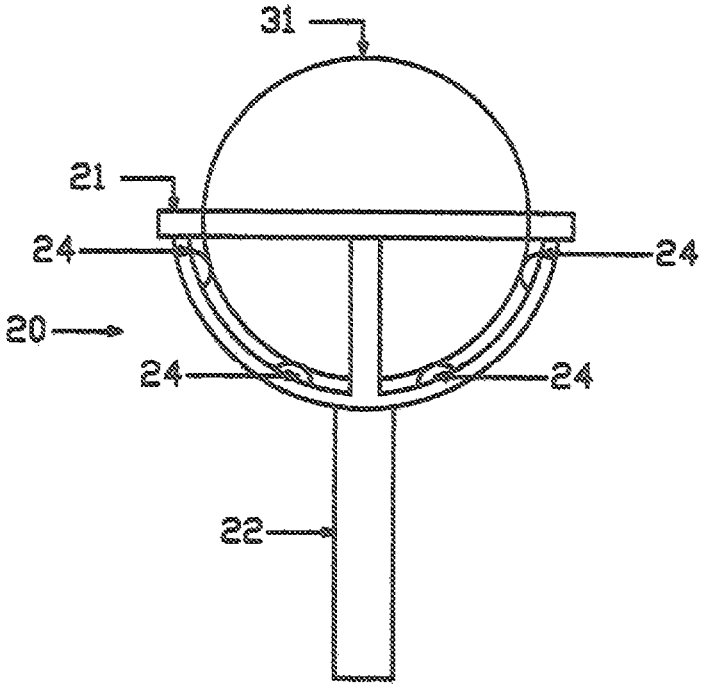
FIGS. 7A and 7B are side and top views respectfully of the roller structure means having bearing elements for making movement of the roller engagement means smoother.
Figure 7B:
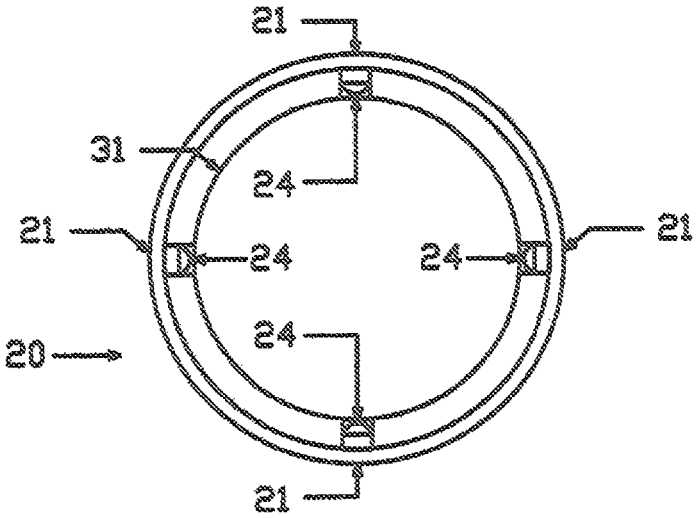

FIGS. 7A and 7B demonstrate a roller structure means 20 which utilize bearings to make rotation of spherical roller element 31 smoother. As may be seen, bearing elements 24, which may be a type of roller or slider bearings, may be mounted to the roller support member 21 of roller structure means 20 at various positions. Thus when spherical roller element 31 moves against bearing elements 24, instead of directly against roller support member 21, the amount of friction is reduced, making movement smoother and easier.

Figure 8A:
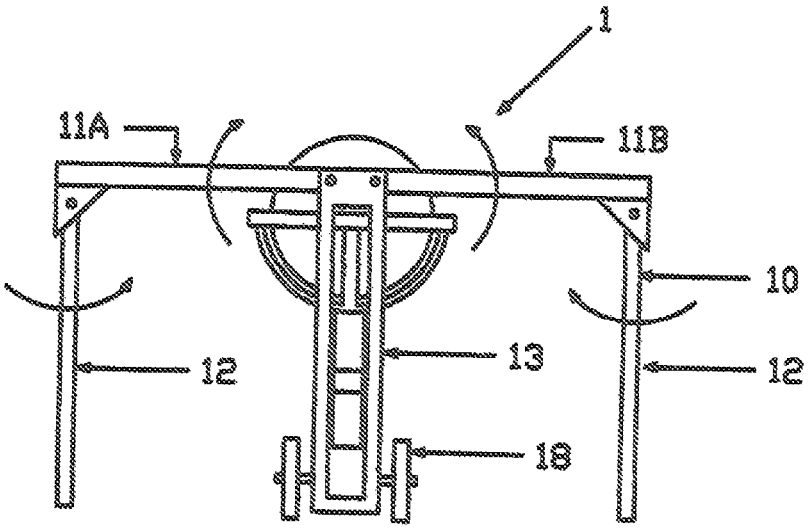
FIGS. 8A and 8B are front views of the body roller apparatus having a collapsible frame structure means, along with wheel elements, which makes for easy transport and storage of the apparatus.
Figure 8B:
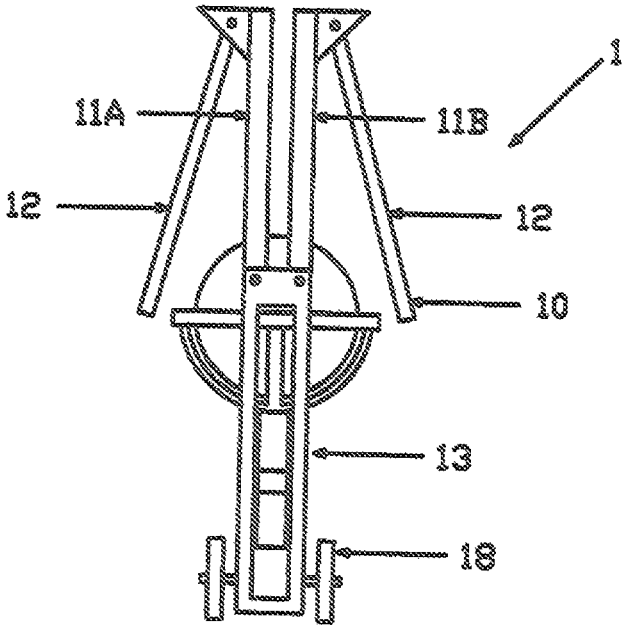

As may be seen in FIGS. 8A and 8B, the frame structure means 10 may have a collapsible feature which makes the apparatus easier to store and transport. User support member 11 may be composed of two separate components 11A and 11B, each of which may be pivotally mounted to main support members 13 so that they may be pivoted in the upward direction. Also, side support members 12 may be pivotally mounted to user support members 11A and 11B so that they may be folded inward, towards the underside of user support members 11A and 11B. User support members 11A and 11B may be secured in the upward position, while side support members 12 may be secured in their inward position, through some type of securing means such as a chord, rope, or tie. Alternately, a type of lock and release mechanism, which is commonly found in folding tables, may be utilized. The ability to collapse the apparatus greatly reduces the amount of horizontal space the apparatus encompasses while being stored or transported. Also, wheel elements 18 may be attached to main support members 13 to also make storage and transport easier.

Figure 9A:
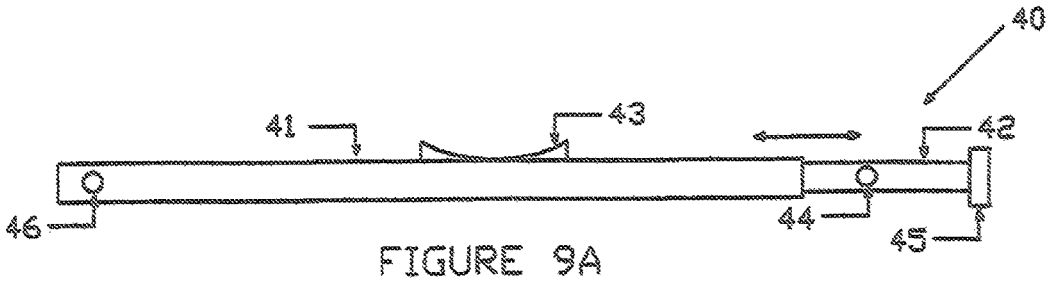
FIG. 9A is a side view of the lever adjusting means of the body roller apparatus which may be used to adjust the roller structure means in the upward and downward directions.
Figure 9B:
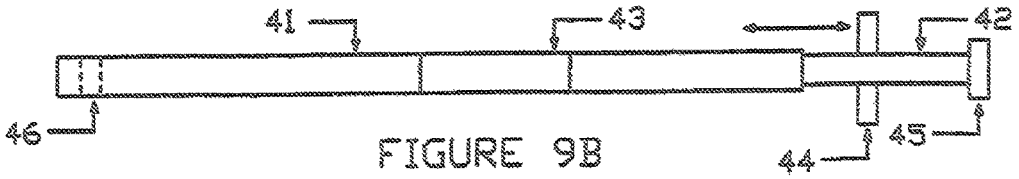
FIG. 9B is a top view of the lever adjusting means of the body roller apparatus which may be used to adjust the roller structure means in the upward and downward directions.
Figure 9C:
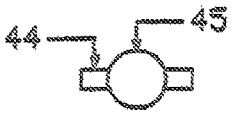
FIG. 9C is a front view of the lever adjusting means of the body roller apparatus which may be used to adjust the roller structure means in the upward and downward directions.

FIGS. 9A, 9B, and 9C demonstrate a lever adjusting means 40 which may also be part of the body roller apparatus 1. Lever adjusting means 40 is comprised of a first member 41 and a second member 42. First member 41 may be a tubular-type structure sized to receive second member 42, such that second member 42 may move back and forth within first member 41. First member 41 is pivotally mounted at one end to one of the main support members 13 of frame structure means 10. First member 41 may have a vertical opening 47 and main support member 13 may have a vertical opening 48, which may be aligned with one another and a bolt or pin placed through each to pivotally secure the two together.

Figure 9D:
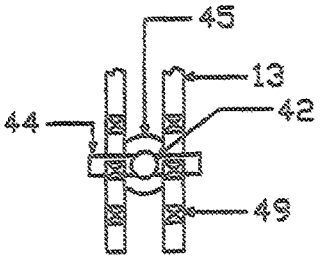
FIG. 9D is a front view of the lever adjusting means of the body roller apparatus demonstrating how the lever adjustment means may adjustably mount to the frame structure means.

The other free end of first member 41 is used to receive one end of second member 42. As may be seen, this end of second member 42 fit within first member 41. The opposite end may have a handle member 45 mounted thereon. The handle member 45 is used by the user to move second member 42 within first member 41, and is also used to pivot first member 41 in the upward and downward directions. Perpendicularly mounted to second member 42 is a securing member 44. As may be seen in FIG. 9D, mounted at various intervals along the other main support member 13 of frame structure means 10 are mounting brackets 49. These mounting brackets 49 are constructed to securely hold securing member 44 such that first member 41 and second member 42 are not allowed to move or pivot. As may also be seen, first member 41 may have a curved support member 43.

Figure 10A:
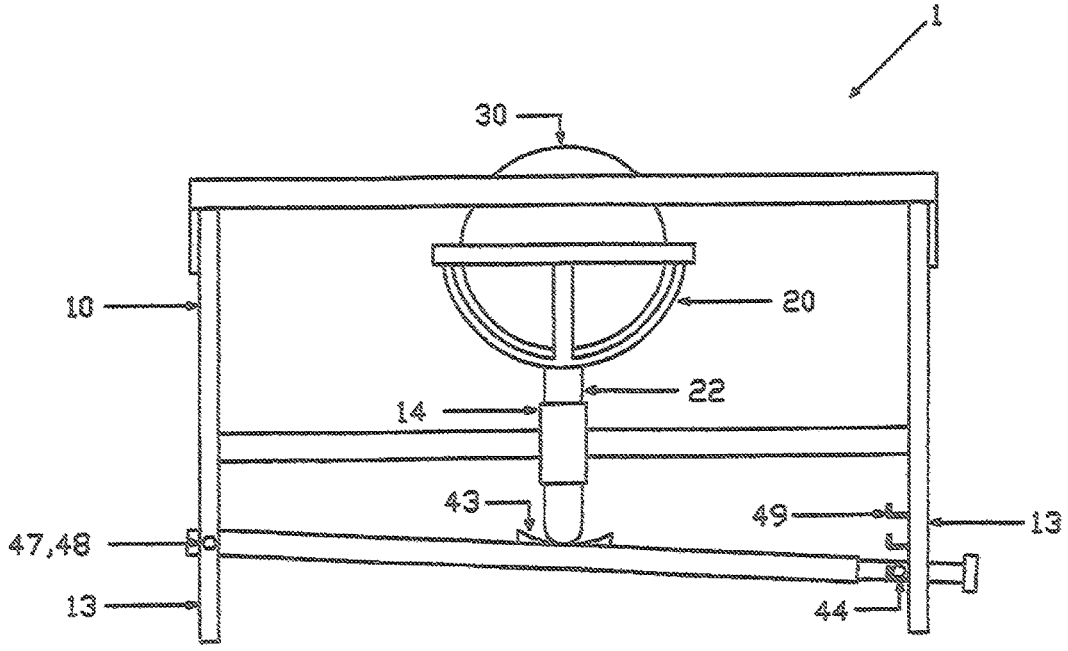
FIG. 10A is a side view of the body roller apparatus demonstrating how the lever adjusting means may be used to position the roller structure means at a lower elevation.
Figure 10B:
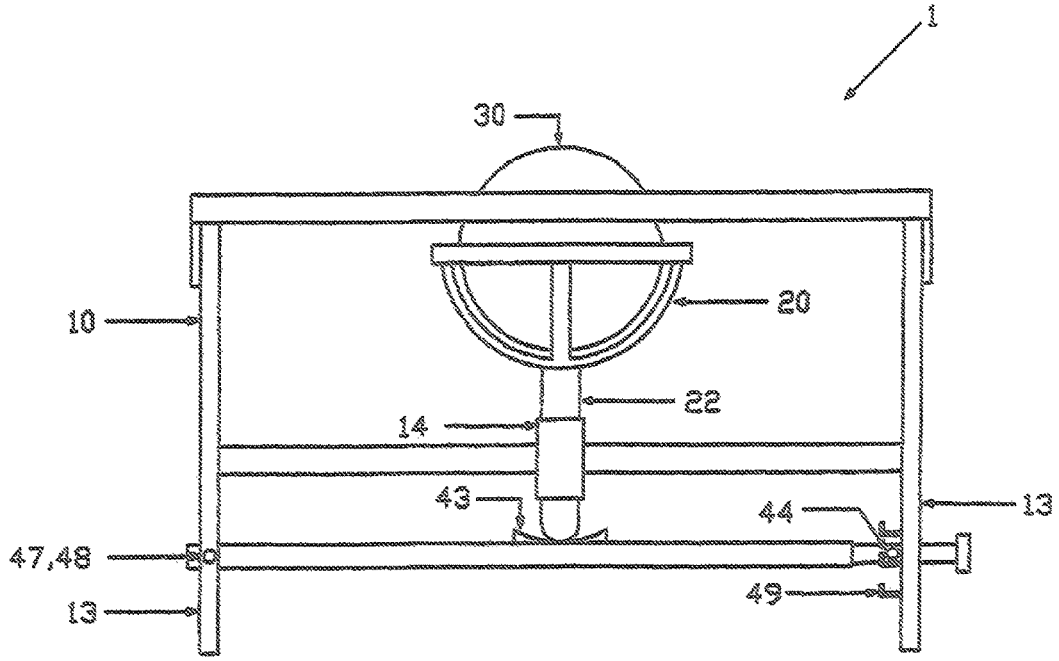
FIG. 10B is a side view of the body roller apparatus demonstrating how the lever adjusting means may be used to position the roller structure means at a middle elevation.
Figure 10C:
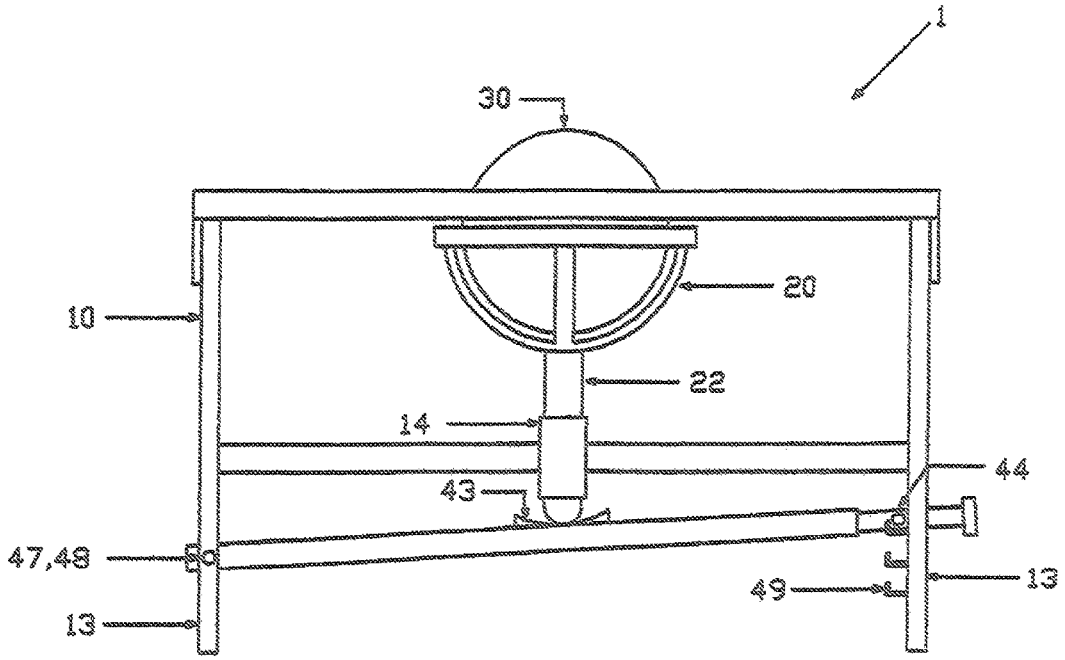
FIG. 10C is a side view of the body roller apparatus demonstrating how the lever adjusting means may be used to position the roller structure means at a higher elevation.

As may be seen in FIGS. 10A-10C, the lever adjusting means 40 may be used to secure the main roller structure member 22 of roller structure means 20 at various elevations along roller structure support member 14, the adjusting means 40 is used to support the lower end of main roller structure member 22, instead of using a bolt or pin as has been previously shown.

As shown, the lever adjusting means 40 may be pivoted mounted at one end to one main support member 13, and secured at the opposite end to the other main support member 13 using securing member 44 and mounting brackets 49. This allows roller structure means 20 to be positioned at various elevations. To change the elevations, the user would grasp handle member 45 with their hand, pivot first member 41 upward so that securing member 44 is above the current set of mounting brackets 49, push second member 42 further into first member 41, pivot first member 41 to the desired new elevation, pull second member 42 and securing member 44 back towards and above the new set of mounting brackets 49, and lower securing member 44 onto these mounting brackets 49 so that they are secured to one another.

As mentioned previously, support member 43 may have a curved upper surface, while main roller structure member 22 may also have a curve lower end. These curved features should allow the contact point between the two to remain relatively perpendicular, no matter the position of the lever adjusting means 40.

Many variations of the body roller apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A body roller apparatus comprising:

a frame structure means comprising a base frame structure with a user support member mounted thereon, said user support member being a tabletop-shaped structure having a generally horizontal upper surface and a vertical through opening;

a roller engagement means comprising a spherical roller element which has a generally spherical shape, a lower portion and an upper portion, and a generally continuous surface;

a roller structure means comprising an upwardly oriented, generally bowl-shaped roller support member mounted to said base frame structure of said frame structure means and sized to rotatably receive and support said lower portion of said spherical roller element of said roller engagement means such that said spherical roller element rotates independent of said user support member in any direction and has multiple axes of rotation; said roller support member mounted to said base frame structure of said frame structure means below said user support member such that at least a part of said upper portion of said spherical roller element of said roller engagement means extends through said vertical through opening and above said upper surface of said user support member of said frame structure means;

said roller structure means further comprising a roller structure member having a first end and a second end, said roller support member fixedly mounted to said first end of said roller structure member, with said second end of said roller structure member fixedly mounted to said base frame structure of said frame structure means;

a lever adjustment means operatively engaging said roller support member such that said roller support member is movable in the generally upward and downward directions and secured at various intervals;

whereby a user positions himself/herself in a laying position upon said generally horizontal upper surface of said user support member of said frame structure means and engage the upper portion of said roller engagement means which extends above the upper surface of said user support member with different body muscle groups.

2. The body roller apparatus as claimed in claim 1, said spherical roller element of said roller engagement means having a generally continuous surface which is relatively smooth.

3. The body roller apparatus as claimed in claim 1, said base frame structure of said frame structure means further comprising right and left side support members; front and rear main support members, cross support members rigidly connecting said front and rear main support members, and a roller structure support member supported by said cross support members, said user support member of said frame structure means having a front end, rear end, right side, and left side, with said front and rear ends being supported by said front and rear main support members respectively, and said right and left sides being supported by said right and left side support members respectively.

4. The body roller apparatus as claimed in claim 1, said vertical through opening of said user support member of said frame structure means located in its general center.

5. The body roller apparatus as claimed in claim 3, said roller structure support member of said base frame structure of said frame structure means having an opening means, and said roller support member of said roller structure means having an opening means, said opening means of each being capable of alignment such that a bolt or pin is placeable through each opening means to secure said roller structure support member and said roller structure member to one another.

6. The body roller apparatus as claimed in claim 5, said roller structure member having several opening means located at various positions along its length such that said roller support member of said roller structure means is securable at different elevations to said roller structure support member, so that at least a portion of said spherical roller element of said roller engagement means is securable at different elevations above the upper surface of said user support member of said frame structure means.

7. The body roller apparatus as claimed in claim 3, user support member of said frame structure means further comprising right and left components with ends, each of said right and left components pivotally mounted at one end of said ends to said front and rear main support members of said base frame structure respectively such that each of said right and left components of said user support member is foldable towards one another; and another end of said ends of each of said right and left components of said user support member having said right and left side support members of said base frame structure pivotally mounted thereon respectively, such that said right and left side support members are foldable underneath said right and left components of said user support member; whereby said frame structure means is collapsible.

8. The body roller apparatus as claimed in claim 1, said lever adjustment means comprising a lever having a first member and a second member, said first member sized to rotatably and slideably receive said second member, said first member pivotally mounted to said frame structure means of said body roller apparatus, said second member securable to said frame structure means at various intervals, whereby said first member engages said roller support member and move said roller support member in the upward and downward directions, with said second member of said lever of said lever adjustment means being used to secure said roller support member at various intervals.

9. A body roller apparatus comprising:

a frame structure means comprising a base frame structure with a user support member mounted thereon, said base frame structure of said frame structure means further comprising right and left side support members and front and rear main support members, said user support member having a generally horizontal upper surface with a vertical through opening and comprising right and left components with ends, each of said right and left components pivotally mounted at one end of said ends to said front and rear main support members of said base frame structure respectively such that each of said right and left components of said user support member is foldable towards one another; and another end of said ends of each of said right and left components of said user support member having said right and left side support members of said base frame structure pivotally mounted thereon respectively, such that said right and left side support members are foldable underneath said right and left components of said user support member; whereby said frame structure means is collapsible;

a roller engagement means comprising a spherical roller element which has a generally spherical shape, a lower portion and an upper portion, and a generally continuous surface;

a roller structure means comprising a main roller structure member with an upwardly oriented, generally bowl-shaped roller support member mounted thereon, said roller support member sized to rotatably receive and support the lower portion of said spherical roller element of said roller engagement means; said roller structure means mounted to said base frame structure of said frame structure means such that said spherical roller element rotates independent of said user support member in any direction, and such that at least a part of said upper portion of said spherical roller element of said roller engagement means extends through said vertical through opening and above said upper surface of said user support member of said frame structure means;

whereby a user positions himself/herself in a laying position upon said generally horizontal upper surface of said user support member of said frame structure means and engage the part of the upper portion of the spherical roller element of said roller engagement means which extends above the upper surface of said user support member with different body muscle groups.

10. The body roller apparatus as claimed in claim 9, said vertical through opening of said user support member of said frame structure means located in its general center.

11. The body roller apparatus as claimed in claim 9, further comprising a roller structure support member of said base frame structure having an opening means, said main roller structure member of said roller structure means having an opening means, said opening means of each capable of alignment such that a bolt or pin is placeable through each opening means to secure further comprising a roller structure support member and said main roller structure member to one another.

12. The body roller apparatus as claimed in claim 9, said spherical roller element of said roller engagement means having a generally continuous surface which is relatively smooth.

13. The body roller apparatus as claimed in claim 11, said main roller structure member having several opening means located at various positions along its length such that said main roller structure member of said roller structure means is securable at different elevations to said roller structure support member, so that at least a portion of said spherical roller element of said roller engagement means is securable at different elevations above the upper surface of said user support member of said frame structure means.

14. The body roller apparatus as claimed in claim 9, said user support member of said frame structure means having a front end, rear end, right side, and left side, with said front and rear ends being supported by said front and rear main support members respectively, and said right and left sides being supported by said right and left side support members respectively; said base frame structure of said frame structure means having cross support members rigidly connecting said front and rear main support members; a roller structure support member mounted on said cross support members and fixedly mounted to a lower end of said main roller structure member of said roller structure means; and said roller support member being fixedly mounted to an upper end of said main roller structure member of said roller structure means.

15. The body roller apparatus as claimed in claim 9 further comprising a lever adjustment means operatively engaging said roller support member such that said roller support member is moveable in the generally upward and downward directions and secured at various intervals.

16. The body roller apparatus as claimed in claim 15, said lever adjustment means comprising a lever having a first member and a second member, said first member sized to rotatably and slideably receive said second member, said first member pivotally mounted to said frame structure means of said body roller apparatus, said second member securable to said frame structure means at various intervals, whereby said first member engages said roller support member and move said roller support member in the upward and downward directions, with said second member of said lever of said lever adjustment means being used to secure said roller support member at various intervals.

* * * * *